United States Patent [19]

Dahms

[11] 4,419,192

[45] Dec. 6, 1983

[54] METHOD FOR GALVANIC DEPOSITION OF COPPER

[75] Inventor: Wolfgang Dahms, Berlin, Fed. Rep. of Germany

[73] Assignee: Schering Aktiengesellschaft, Berlin and Bergkamen, Fed. Rep. of Germany

[21] Appl. No.: 244,727

[22] Filed: Mar. 17, 1981

[30] Foreign Application Priority Data

Mar. 27, 1980 [DE] Fed. Rep. of Germany ..... 3012168

[51] Int. Cl.[3] ..... C25D 3/38

[52] U.S. Cl. ..... 204/15; 204/52 R; 204/231

[58] Field of Search ..... 204/52 R, 231, 15, 106

[56] References Cited

U.S. PATENT DOCUMENTS 1,465,034 8/1923 Antisell ..... 204/52 R 2,133,255 10/1938 Rogers ..... 204/52 R X

OTHER PUBLICATIONS

Research Disclosure, #19045, Feb. 1980.

V. I. Lainer, "Modern Electroplating", pp. 109–113, (1970).

J. K. Dennis et al., "Nickel and Chromium Plating", pp. 67–68, (1972).

J. Homer Winkler, Preprint 80–28, The Electrochemical Soc., pp. 349–354, (1941).

*Primary Examiner*—G. L. Kaplan

*Attorney, Agent, or Firm*—Michael J. Striker

[57] ABSTRACT

In a method for galvanic deposition of smooth and ductile copper from acid copper baths, the metal content of the bath is kept constant by using inert anodes together with soluble anodes. The inert anodes are made of precious metal, precious metal alloys or their compounds. The ratio of the geometric surface of inert to soluble anode should amount to from 1:1 to 1:200, preferably from 1:5 to 1:20. The inert anode may be provided with additional potential, and the acid bath may contain organic thio compounds. The method is useful for building up conductor paths of printed circuits.

7 Claims, No Drawings

METHOD FOR GALVANIC DEPOSITION OF COPPER

BACKGROUND OF THE INVENTION

The invention concerns a method for the galvanic deposition of smooth and ductile copper from acid copper baths, the metal content of which remains unchanged during the deposition.

Acid copper baths are customarily run with soluble copper anodes. These are hung in baskets in the bath in the form of wire bars, ingots or also as granulates or pieces, and deliver, with anodic connections corresponding to the quantity of current according to Faraday's Law, approximately 100% yield of copper ions in the electrolyte. In so doing it has been shown that it is significant to add small amounts of phosphorus to the copper so that the anodes, through formation of a uniform anode film, will dissolve better and display no passive spots.

Such copper baths, particularly with a content of organic thio compounds, find use predominantly for galvanic deposition of smooth and ductile copper. A preferred field of application is the building up of conductor paths on printed circuits.

Acid copper baths have, however, the disadvantage that in particular at high acid concentrations, besides the anodic dissolution of the anodes, also a chemical dissolution results, whereby the copper content in the bath is strongly increased. These baths must therefore be expensively controlled and from time to time thinned out, since this high copper concentration can give rise to a defective distribution of the deposited copper and even a crack in the printed circuit conductor paths with thermal stress.

SUMMARY OF THE INVENTION

The object of the present invention is therefore the development of a method which allows for the galvanic deposition of smooth and ductile copper from acid copper baths without changing the metal content of the baths.

This object is achieved according to the invention through a method of the designated type, characterized in that inert anodes of precious metal, precious metal alloys or their compounds, together with soluble anodes, are used.

Particular embodiments of this method include using inert anodes of platinum, iridium, rhodium, palladium, gold, ruthenium, rhenium, their alloys, oxides or carbides;

using anodes in which the ratio of geometric surface of inert to soluble anode amounts to from 1:1 to 1:200, preferably from 1:5 to 1:20;

providing the inert anode additionally with a potential;

using acid copper bath containing organic thio compounds.

During the realization of the method according to the invention, the metal content of the copper bath remains, surprisingly, practically constant, which is particularly advantageous. So qualified this method has exceptional advantages for strengthening the conductor paths of printed circuits, which are thermally highly burdenable.

Further advantages are that the baths require smaller portions of gloss additives, the expenditure for which is reduced up to 60%, and that the in practice frequently necessary oxidation for the activation of the inhibitors or for destroying the decomposition products can be obviated. It has been generally found that even in the macrometal distribution can be improved.

As inert anodes which are generally used according to the invention along with easily dissolved copper anodes, included are such as from precious metal, precious metal alloys or their compounds.

In particular may be mentioned, by way of example, anodes of platinum, iridium, rhodium, palladium, gold, ruthenium, rhenium, their alloys, oxides and carbides. These metals, their alloys and compounds can also have inert supporting material, appropriately applied in thin coatings, such as for example of magnetite, titanium, graphite, lead or tantalum.

It has furthermore been found that the baths, upon accomplishment of the method according to the invention, display optimal characteristics when the ratio of the geometric surfaces of inert to soluble anodes amounts to from 1:1 up to 1:200, preferably from 1:5 to 1:20.

By geometric surfaces are meant surfaces which one obtains from the product of length times width of the sides of the anodes which face the cathode, whereby microunevennesses are not taken into account for the calculation.

It has surprisingly been shown that one can decrease the surface portion of the inert anodes, even up to 1% of the entire geometric anode surface, if the anodes are separately controlled. This is attained by means of an additional direct current source, which selectively governs the strength of oxidation and surprisingly reduces the necessary surface of the inert anode. In this manner the inert anode is additionally provided with an anodic potential, so that it will be charged still more positively than the easily dissolved copper anode.

Customary compounds are used for the acid copper bath. In general an aqueous bath of the following composition will be used:

| | |
|---|---|
| copper sulfate ($CuSO_4.5H_2O$) | 50–250 g/Liter, |
| preferably | 60–80 g/Liter, |
| sulfuric acid | 50–250 g/Liter, |
| preferably | 180–220 g/Liter, |
| sodium chloride | 0.05–0.25 g/Liter, |
| preferably | 0.06–0.1 g/Liter. |

Along with copper sulfate other copper salts can also at least partially be used. In addition, the sulfuric acid can partially or completely be substituted by fluoroboric acid, phosphoric acid, or other acids. The bath can also be produced free of chloride.

In general, the bath may contain as additives customary brightness formers and/or moistening agents.

The operating conditions of the bath are as follows:

| | |
|---|---|
| pH value | <1 |
| temperature | 15–35° C., |
| preferably | 25° C. |
| cathode current density | 0.5–8 A/dm$^2$, |
| preferably | 2–4 A/dm$^2$. |

Agitation of the electrolyte follows through blowing in of clean air, so strongly that the surface of the electrolyte becomes highly agitated.

Particular advantages are seen when acid copper baths are used which contain organic thio compounds as additives, in which sulfur can be in the form of di-, tetra- and/or hexa-valent, or polymers. It has been demonstrated that these sulfur-containing inhibitors, through the use in combination of inert and soluble anodes, result in an optimal redox equilibrium. This adjustment of the oxidation-reduction balance is of noteworthy significance when the anode surface is very large in comparison to the cathode surface.

As organic thio compounds the following in particular are used:

| Organic thio compounds | Preferred concentration in g/liter |
|---|---|
| N,N—diethyl-dithiocarbaminic acid-w-sulfopropyl-ester sodium salt | 0.01–0.1 |
| mercaptobenzothiazol-S—propane sulfonic acid sodium | 0.02–0.1 |
| 3-mercaptopropane-1-sulfonic acid sodium | 0.005–0.1 |
| thiophosphoric acid-O—ethyl-bis-(w-sulfopropyl)-ester, disodium salt | 0.01–0.15 |
| thiophosphoric acid-tris-(w-sulfopropyl)-ester, trisodium salt | 0.02–0.15 |
| isothiocyanopropylsulfonic acid sodium | 0.05–0.2 |
| thioglycolic acid | 0.001–0.003 |
| ethylenedithiodipropylsulfonic acid sodium | 0.01–0.1 |
| thioacetamide-S—propylsulfonic acid sodium | 0.005–0.03 |
| di-n-propylthioether-di-w-sulfonic acid, disodium salt | 0.01–0.1 |

The use of inhibitors based upon selenium-containing compounds, alone or in mixture with the thio compounds, is likewise possible.

The novel features which are considered as characteristic for the invention are set forth in particular in the appended claims. The invention itself, however, both as to its construction and its method of operation, together with additional objects and advantages thereof, will be best understood from the following description of specific embodiments.

DESCRIPTION OF THE PREFERRED EMBODIMENTS

The following examples serve for illustration of the invention:

EXAMPLE 1

For operation of a 10 liter copper bath, two copper plates were joined up by means of an anode strip and connected as anodes. The geometric surface of both amounted to about 4.0 $dm^2$. As cathode, a conductor plate with a geometric surface of 0.5 $dm^2$ was used. Copper electrolyte was added in the amount:

80 g/l copper sulfate ($CuSO_4.5H_2O$)
180 g/l concentrated sulfuric acid
0.08 g/l sodium chloride.

As brightness former 0.6 g/l polypropyleneglycol (A) and
0.02 g/l 3-mercaptopropane-1-sulfonic acid, sodium salt (B)

were added.

The consumption of compound (B) was determined through a Hull cell examination, and the increase of metal determined by means of analysis.

The deposition was slightly fogged, being matte in the lowest range of the current density.

Then this experiment was repeated under additional use of two plates of platinized expanded titanium metal as inert anode. These plates were so fastened to the same anode strip that upon each side of the tank a strip of platinized titanium and a copper plate were found.

The percent portion of inert anode in the total geometrical anode surface came to 10%. The following results were obtained:

| % portion of inert anode in total anode surface | consumption of Compound B per 10,000 Ah in g | metal increase (+) or metal decrease (−) in g/liter 10,000 Ah |
|---|---|---|
| 0 | 3.0 | +11 |
| 10 | 1.2 | ±0 |

With additional use of inert anode a clear reduction of the matte zone was perceptible, which otherwise can be removed only with sodium persulfate.

These results demonstrate that the simultaneous use according to the invention of inert precious metal and easily dissolved copper anodes causes a strong reduction in the consumption of organic thio compounds and an increase in the metal ion concentration was no longer observed. Moreover, a charge of oxidation agents was unnecessary.

EXAMPLE 2

As in Example 1, two copper anodes were used, this time held in common with a fine gold anode as inert anode. This was, however, not bound by means of an anode strip with the titanium basket but rather charged with an additional anodic potential, so that it was yet more positively charged than the copper anode. The additional potential was obtained through a second rectifier. The surface ratio of this fine gold anode amounted to 2% of the total geometric anode surface. The potential of the fine gold anode was thus so regulated that the separation of acid was directly visible. Then the potential had to be reduced by about 10–20% in order to obtain the best results.

The potential between cathode and copper anode amounted to 1.4 volts, that between both anodes 0.6 volt.

The consumption of compound (B) turned out to be, although the portion of inert anode in the total geometric anode surface amounted to only 2%, near 1.4 g per 10,000 Ah. There was no established no metal increase. This result proves that by means of an additional potential the required inert anode surface can be decreased, which with precious metal anodes is extremely economical. The other advantages of the method according to the invention remain, in spite of that, completely maintained.

It will be understood that each of the elements described above, or two or more together, may also find a useful application in other types of galvanic processes differing from the types described above.

While the invention has been illustrated and described as embodied in a method for galvanic deposition of copper, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. Method for galvanic deposition of smooth and ductile copper from acid copper baths, the metal content of which baths remains unchanged during the deposition, comprising the steps of providing an acid copper bath, inserting the object to be plated into said bath, connecting said object as a cathode, immersing into said bath a combination of soluble anode and inert anode composed of precious metal, precious metal alloys or their compounds, connecting said anodes to a source of electrical energy, using the anodes in which the ratio of the geometric surface of inert to soluble anode amounts to from 1:1 to 1:200, and providing the inert anode additionally with a potential.

2. Method according to claim 1, wherein said inert anodes are made from platinum, iridium, rhodium, palladium, gold, ruthenium, rhenium, their alloys, oxides or carbides.

3. Method according to claim 1, wherein said ratio amounts to from 1:5 to 1:20.

4. Method according to claim 1, wherein said acid copper baths contain organic thio compounds.

5. Method according to claim 1 for building up the conductor paths of printed circuits.

6. Method according to claim 1, wherein said bath contains selenium compounds.

7. Method according to claim 1, wherein the operating conditions of said baths include pH-value of less than 1, temperature between 15° and 35° C. and cathode current density of 0.5–8 $A/dm^2$.

* * * * *